US007520110B2

(12) United States Patent
Asioli

(10) Patent No.: US 7,520,110 B2
(45) Date of Patent: Apr. 21, 2009

(54) SELF-PROPELLING MACHINE FOR WRAPPING STACKED LOADS WITH PROTECTIVE FILM

(75) Inventor: Davide Asioli, Reggio Emilia (IT)

(73) Assignees: ASPO Societa' a Responsabilita' Limitata, Modena (IT); Italdibipack S.p.A., Pogliano Milanese-Milan (IT)

( * ) Notice: Subject to any disclaimer, the term of this patent is extended or adjusted under 35 U.S.C. 154(b) by 149 days.

(21) Appl. No.: 11/578,740

(22) PCT Filed: Apr. 29, 2005

(86) PCT No.: PCT/EP2005/004641

§ 371 (c)(1),
(2), (4) Date: Oct. 17, 2006

(87) PCT Pub. No.: WO2005/110852

PCT Pub. Date: Nov. 24, 2005

(65) Prior Publication Data

US 2007/0169442 A1 Jul. 26, 2007

(30) Foreign Application Priority Data

Apr. 30, 2004 (IT) ..... RE2004A0046

(51) Int. Cl.
*B65B 13/04* (2006.01)
*B65B 11/00* (2006.01)

(52) U.S. Cl. ..... 53/589

(58) Field of Classification Search ..... 53/588, 53/589, 393, 52, 566, 224
See application file for complete search history.

(56) References Cited

U.S. PATENT DOCUMENTS 4,067,174 A * 1/1978 Goldstein ..... 53/556
4,616,474 A * 10/1986 Morley et al. ..... 53/556

* cited by examiner

*Primary Examiner*—Rinaldi I. Rada
*Assistant Examiner*—John Paradiso
(74) *Attorney, Agent, or Firm*—James V. Costigan; Hedman & Costigan, P.C.

(57) ABSTRACT

Self-propelled machine for wrapping stacked loads with protective film which unwinds from a reel, comprising an elevator system (2) for vertical movement of reel (11), and a mobile supporting carriage (4) said machine, according to the invention, it comprises:—two driving wheels (40, 41) arranged on the same axis, each driven by its own independent motor (42, 43); and—an automatic guidance system (5) with a contact device (50) adapted to follow a contact surface (32) of the stacked load (31) and to detect its distance from the machine, and a servocontrol (51) which is responsive to the distance detected by said contact device (50), adapted to control said driving motors of the machine in such a way that the machine contact surface (32).

6 Claims, 6 Drawing Sheets

SELF-PROPELLING MACHINE FOR WRAPPING STACKED LOADS WITH PROTECTIVE FILM

The present finding refers to a self-propelled machine for wrapping stacked loads with protective film, adapted to move independently, that is without being driven by an operator.

More particularly, this wrapping machine is used in the packaging industry for wrapping and thereby stabilising said stacked loads with a plastic film which unwinds from a reel.

Unlike the more conventional equipment in existence, Involving bulky support frameworks fixed to the ground, machines of this type are able to move around stacked loads, automatically following their shape; as well as doing their job, accordingly, they must be both small enough in bulk to be able to move nimbly between stacked loads and easily transportable.

A self-propelled wrapping machine generally comprises an elevator system enabling a reel-bearing slide to move vertically, a mobile supporting carriage allowing its movement through a system of wheels, and an automatic guidance system enabling the machine to follow the shape of the stacked load automatically, without the help of an operator.

Existing self-propelled wrapping machines are generally fitted with two driving wheels driven by a single motor via a suitable transmission. The wheels are positioned on the rear of the mobile carriage, behind a swivelling wheel with its associated mechanical system for automatic guidance.

Said automatic guidance system comprises, in addition to said swivelling wheel, a control mechanism which controls its steering and a contact roller adapted to stay in contact with the lateral surfaces of the stacked load to be wrapped.

In particular, when in operation the roller is pressed against one of these surfaces by a spring system connected with the control mechanism, and is free to make small horizontal movements to follow the surface's shape; these movements alter the relative positions of roller and machine; this changes the mechanism's configuration, and that in turn steers the wheel accordingly.

For as long as said roller is in contact with a plane surface, the guidance system takes up a pre-set configuration which keeps the steered wheel straight, enabling the machine to proceed in a straight line at a fixed distance from the surface itself.

When, on the other hand, said roller moves past a projection in the shape of the stacked load, it no longer finds itself in contact with the lateral surface, and the mechanism automatically takes up the configuration necessary for steering. In this way the machine turns, and moves around said projection until the roller comes into contact with the next surface of the shape of the stacked load; this brings the system back to its initial state, and the machine's new course is set.

One problem affecting said known machines arises from the fact that said guidance system is not only quite complicated structurally but also results in very wide turns around the stacked load, diminishing the effectiveness of application of the stretch film and, worst of all, extending the area taken up by the machine—that is the free space it requires to move around the stacked load itself.

Furthermore, since the elevator system, and with it the reel-bearing slide, is usually positioned at the rear of the machine in order to be near its driving wheels, the film being applied exerts a drag on the machine in a direction opposite to its motion, and this can in some circumstances cause the steered wheel to lift, making steering ineffective, while in other circumstances it can actually topple the machine itself.

The main purpose of the present finding is to remedy the problems identified above.

Another purpose of the finding is to achieve said object as part of a constructional solution that is simple, rational, reliable and takes up only a limited space.

Said purposes are achieved by means of a guidance system with the characteristics set forth in the Claims.

In the most general sense, a self-propelling wrapping machine according to this finding is equipped with an electromechanical automatic guidance system which acts by suitably adjusting the speed of the driving wheels in such a way as to steer the self-propelling wrapping machine so that it follows the shape of the lateral surfaces of the stacked load.

This results in a steering of a curve of greatly reduced radius, so much so that the machine can follow a course which is essentially around the stacked load; at the same time the absence of any bulky, complicated guidance mechanism means a very small machine can be built, taking up less space.

Moreover, the above solution provides for the reel-bearing slide to be positioned at the front, considerably reducing the risk of the machine tilting or toppling over in operation.

The finding's characteristics and constructional advantages will be clear from the detailed description below, which refers to the figures in the attached drawing sheets; that illustrate a particular and preferred embodiment, merely by way of non-limiting example.

Figure 4:
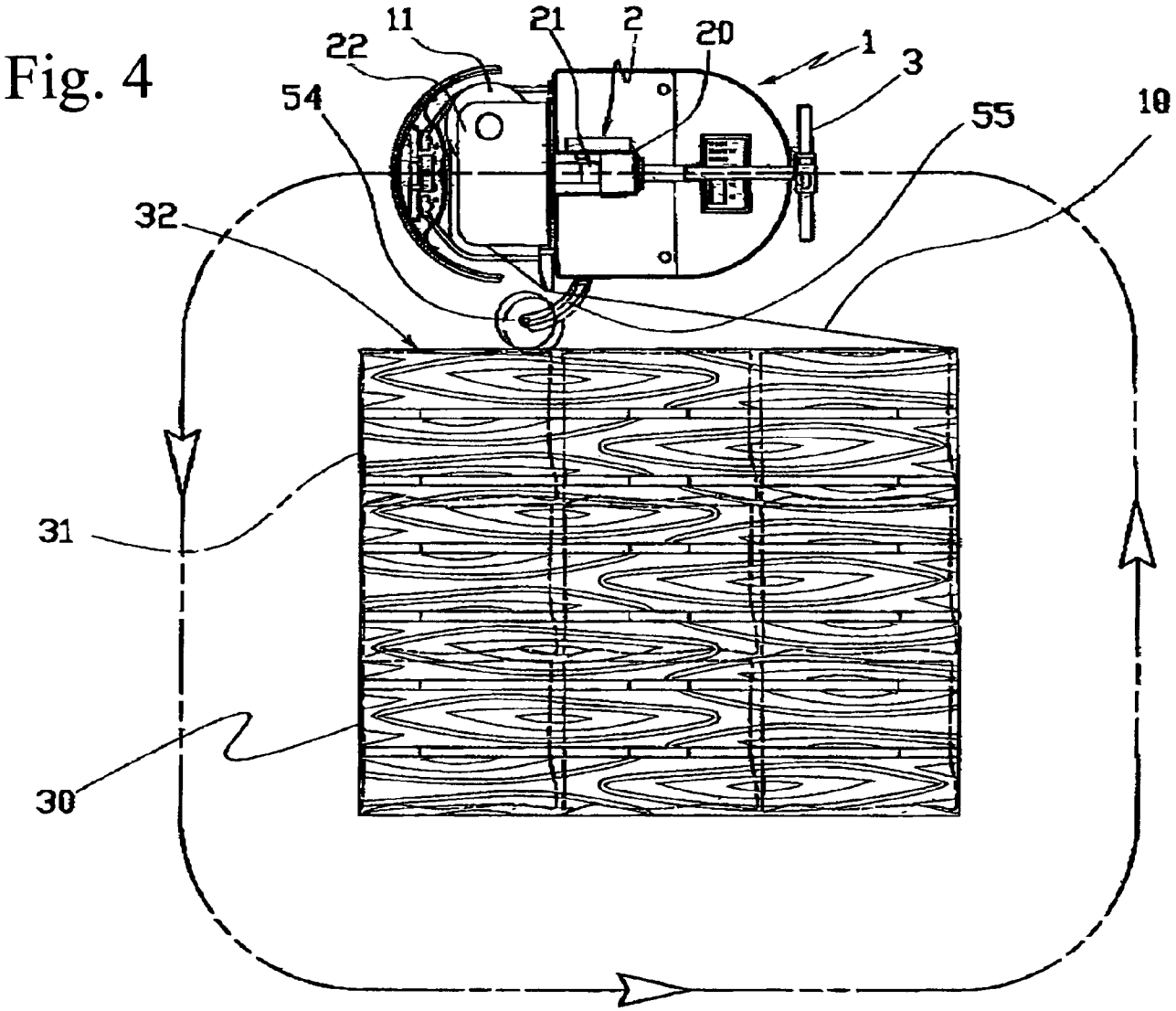
FIG. 4 shows, according to a plan view, the trajectory of the machine illustrated in FIG. 1 during the wrapping of a stacked load.

The invention concerns a self-propelled machine (1) for wrapping stacked loads with stretch film (10) which unwinds from a reel (11), adapted to move around said stacked load automatically following its shape (see FIG. 4).

This self-propelled wrapping machine comprises a supporting mobile carriage (4) adapted to move on the plane of the floor, a handlebar (3) on which the manual steering controls are mounted, and an elevator system (2) mounted on this mobile carriage (4) for moving the stretch film reel (11) vertically.

Said elevator system (2) comprises an upright telescopic unit comprising in particular a fixed pillar (20) upon which slides a moving pillar (21), and a reel-bearing slide (22) adapted in turn to slide upon said moving pillar (21).

Figure 1:
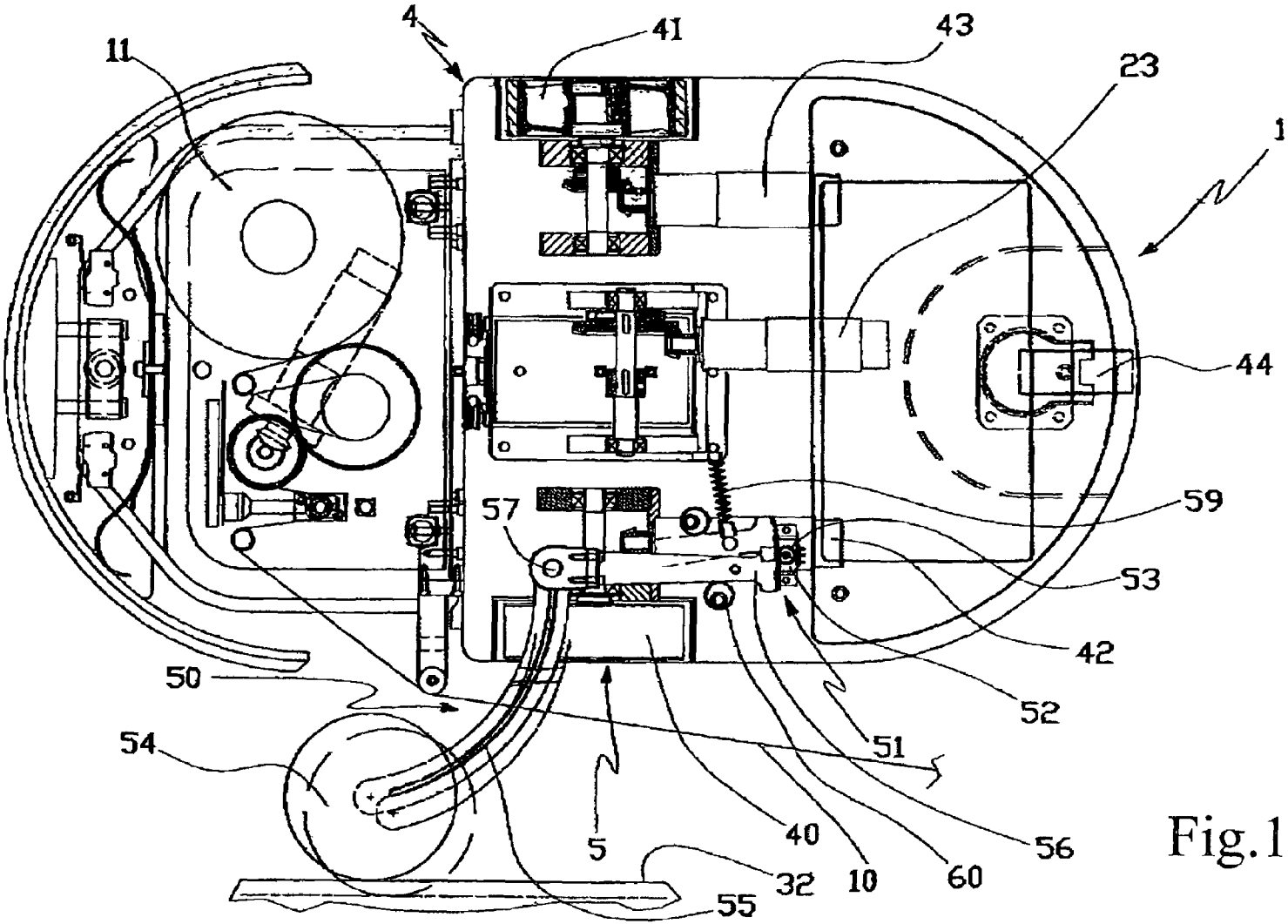
FIG. 1 is a plan view of a wrapping machine according to the invention, in which certain components have been removed in order to show others.

A motor (23) (see FIG. 1) fixed to the machine, can lift the moving pillar (21) by means of a transmission comprising a chain (24) and counterweight (25).

In addition, a second chain (26) with one end anchored to the mobile carriage and the other attached to the reel-bearing slide (22), is arranged to as a pulley running through an idling pinion (27) integral to the mobile pillar (21).

Thus, when the mobile pillar (21) and accordingly also the idling pinion (27) are raised through a given distance with respect to the mobile carriage, said chain (26) raises the reel-bearing slide (22) through twice that distance: this enabling it to reach even very great heights.

According to the invention (see FIG. 1) the self-propelled wrapping machine (1) comprises two driving wheels (40, 41) with the same axis of rotation, positioned respectively on the left- and right-hand sides of the mobile carriage (4), and each driven by its own independent motor (42, 43) respectively; and an automatic guidance system (5) (see FIG. 1A) with a contact device (50) capable of following the stacked load's contact surface and detecting its distance from the machine, and a servocontrol (51) responsive to the distance thus detected that controls said motors (42, 43) in such a way that the machine follows the shape of the contact surface.

Said servocontrol (51) comprises (see FIGS. 1A and 2A) a potentiometer (52) and a pinion (53) splined to a shaft protruding from the potentiometer; that adjusts, while rotating, the electrical signal output by the potentiometer itself which in turn, via a control board, controls the driving wheels (40, 41), respectively, through driving motors (42, 43).

The contact device (50) is free to swing in a horizontal plane, and consists of a contact roller (54), a supporting arm (55) and a gearwheel sector (56).

Figure 1A:
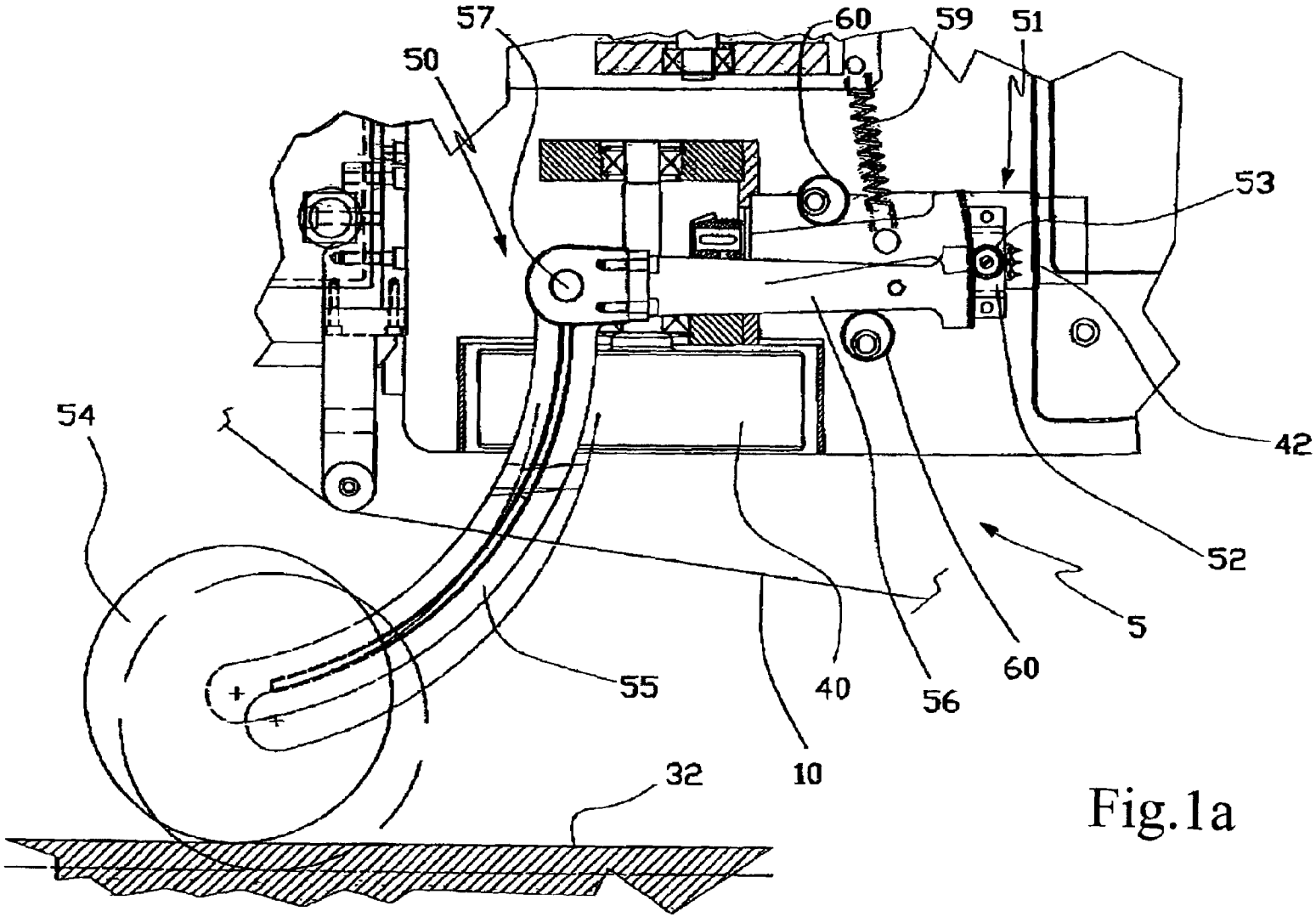
FIG. 1A is a detail of FIG. 1, enlarged.
Figure 2:
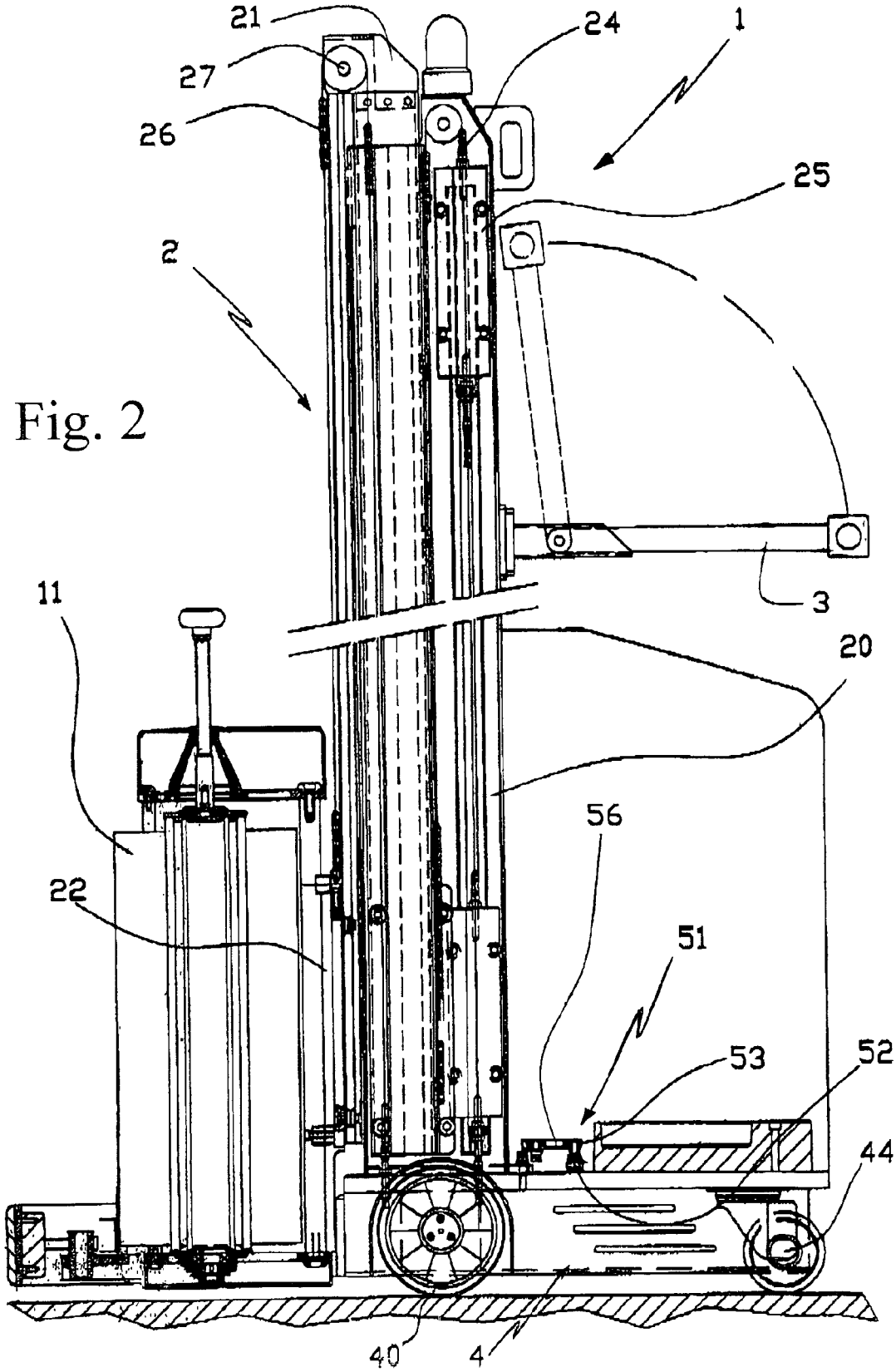
FIG. 2 is a side view of the wrapping machine illustrated in FIG. 1, some parts being shown in cutaway.
Figure 2A:
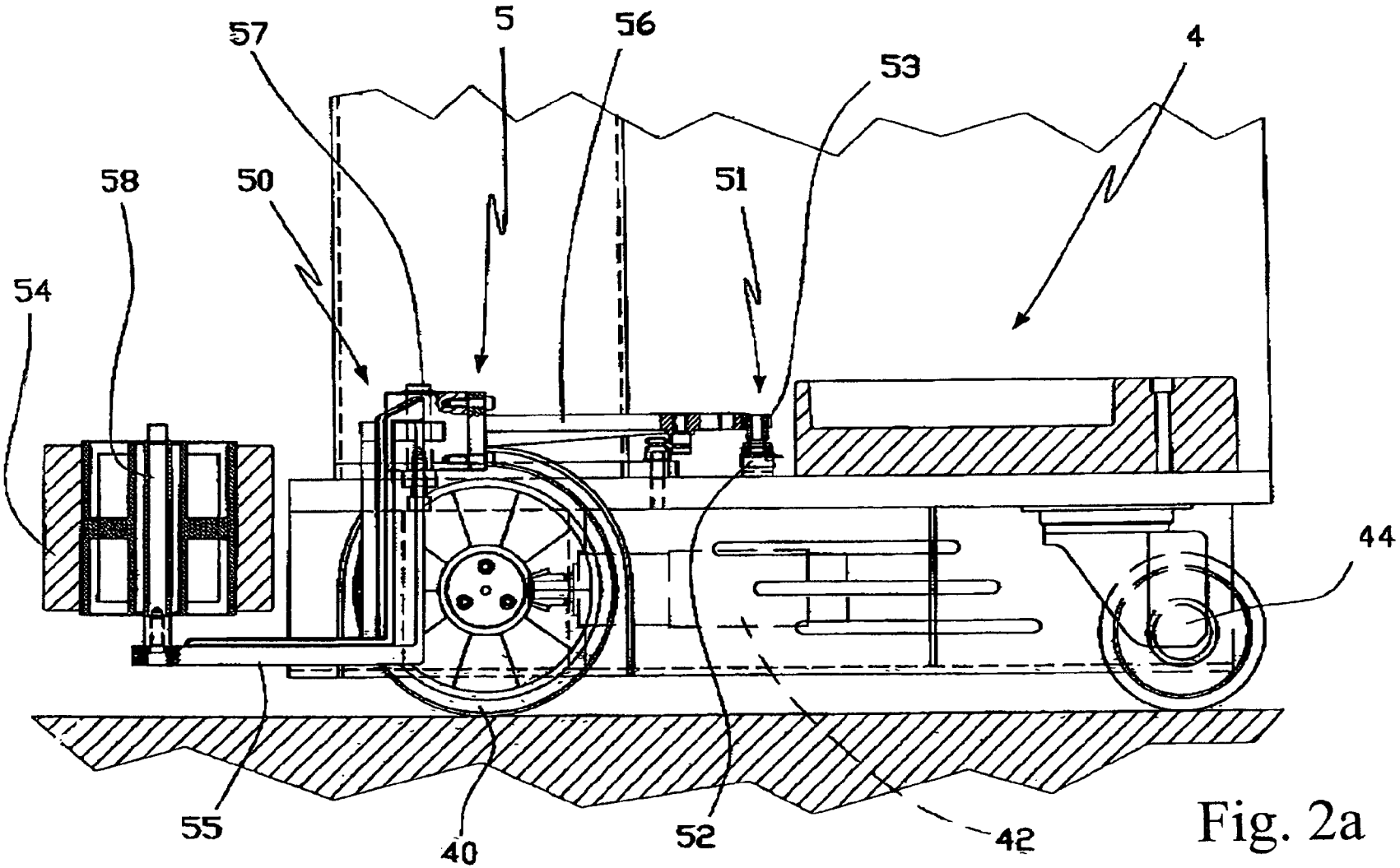
FIG. 2A is a detail of FIG. 2, where some components not visible in FIG. 1 are visible.

One end of said supporting arm (55) is hinged onto the machine by a hinge (57) bolted to the mobile carriage (4), and the other end, free and protruding from the machine, bears said contact roller (54), which is free to pivot around a second hinge (58) bolted to the arm (see FIG. 2A). Furthermore, the gearwheel sector (56) is attached to said supporting arm (55) in such a way that it is coaxial with the hinge (57), or, in other words, it has the hinge (57) at the centre of the pitch circle and, at the same time, in such a way that the gearwheel sector (56) meshes with the pinion (53) of the servocontrol (51) (see FIG. 1A).

Lastly, the automatic guidance system (5) comprises a spring (59) attached to the gearwheel sector (56) and the mobile carriage, its force being transmitted to the contact roller (54) via the contact device (50) which works as a lever; and two cylindrical end-stops (60) integral to the mobile carriage, which limit the above swings of the contact device (50) due to rotation around the hinge (57).

The subject machine is also designed (see FIGS. 2 and 2A) so that the above driving wheels (40, 41) are located in the front part of the mobile carriage (4), ahead of a swivelling wheel (44) attached to the mobile carriage merely for supporting the machine and stabilising its motion, and behind the reel-bearing slide (22).

Figure 3:
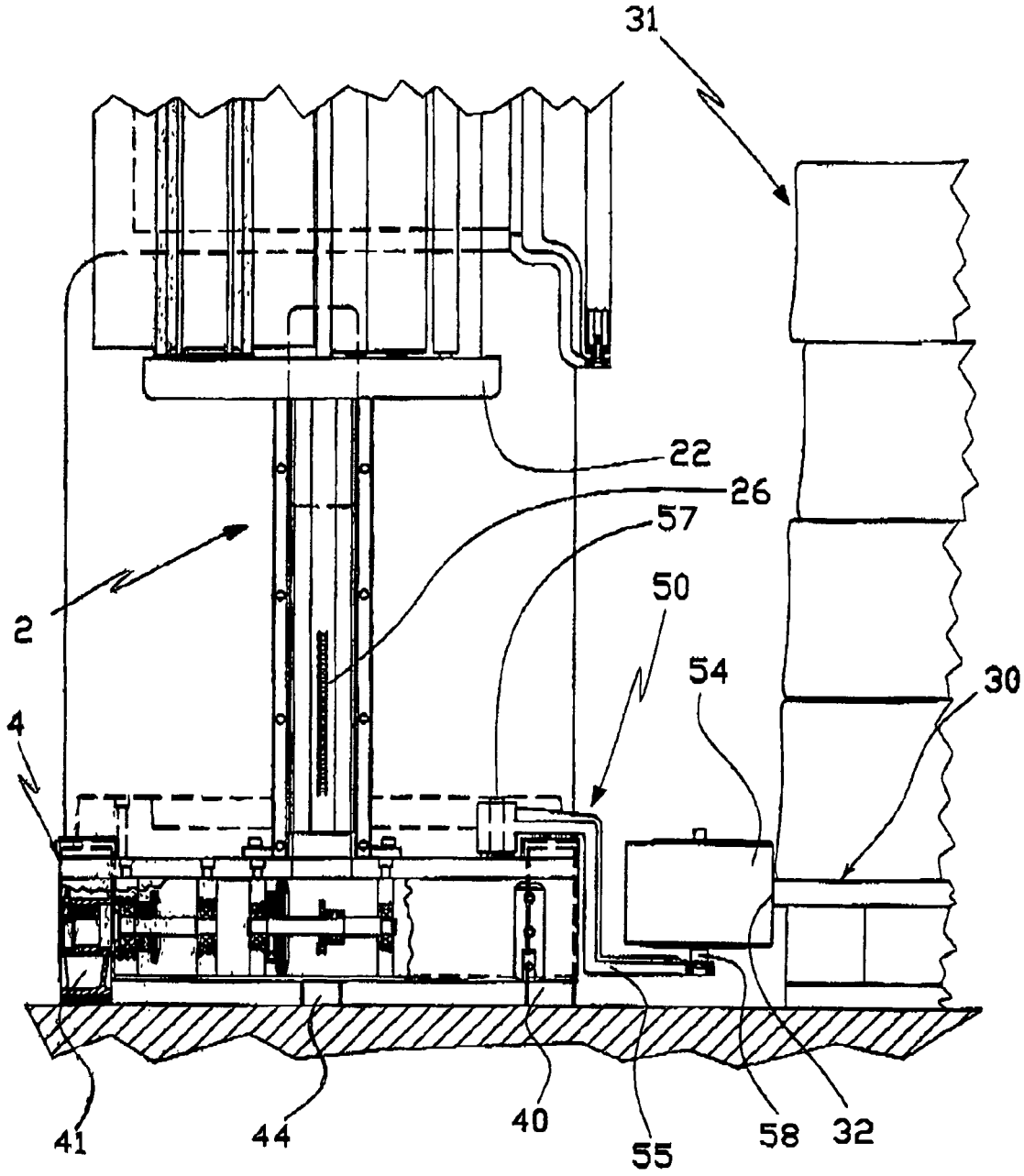
FIG. 3 is a partial front view of the wrapping machine illustrated in FIG. 1, shown during the wrapping stage of a stacked load.

As the wrapping machine (1) advances (see FIGS. 3 and 4), the contact roller (54) of the automatic guidance system (5) rolls along the contact surface of the stacked load (31) to be wrapped, at a constant distance from the machine which is determined by the geometry of the contact device (50) (see FIG. 1A).

Said contact surface may be defined by the lateral and vertical surface (32) of an ordinary pallet (30) bearing the stacked load (31) to be wrapped (as in the case illustrated in the figures), or it may be defined by the lateral (more or less) vertical walls of the stacked load (31) itself.

Contact between the contact device (54) and the contact surface (32) is maintained by means of the spring (59) which uses the leverage of the contact device (50) to press the former against the latter with a given amount of force.

Thus if the surface profile is not straight but variable, then at every change of direction the contact roller (54) is immediately at a different distance from the machine, and this change of distance is detected by the contact device (50). Infact (see FIGS. 1A and 2A) the displacement of the contact roller (54) with respect to the "neutral" position causes a rotation of the supporting arm (55) around the hinge (57) and consequently a rotation of the gearwheel sector (56) through an angle which indicates said change in distance. Since the gearwheel sector (56) is meshed with the pinion (53), any given rotation of the contact device (50) rotates the adjusting shaft of the potentiometer (52) through a corresponding angle determined by the gearing ratio, and consequently a particular electrical signal output from the potentiometer.

This electrical signal controls the speed of the driving wheels (40, 41) via the driving motors (42, 43), in such a way that the machine follows the profile of the contact surface (32).

Thus when the machine moves forward following a straight profile at a constant distance, the signal output by the potentiometer (52) is such as to make the driving wheels (40, 41) move forward with equal speed; in the event of a change of direction, on the other hand, the signal is such as to slow one wheel with respect to the other so that the machine turns, following the profile of the contact surface (32) and restoring the original distance between machine and surface.

There are various means of controlling one driving wheel with respect to the other: for instance, the speed of one wheel could be kept constant while that of the other is varied (until it is stopped); or one wheel could be speeded up and the other slowed down.

In particular (see FIG. 4), the radius of the curve is at a minimum (and the speed difference between the two driving wheels (40, 41) accordingly at a maximum) when the roller (54) has just passed a corner of the pallet (31) (or the stacked load 30), no longer finds itself in contact with any surface, and accordingly allows the contact device (50) to rotate by the greatest angle permitted by the end-stop (60).

The contact roller (54) is set at a fixed height above floor level particularly suitable for following the perimeter surface (32) of the pallets (30) while palletised loads are being wrapped.

Provision could be made for vertical adjustment of said contact roller (54) so as to adapt the machine for wrapping stacked loads whose maximum perimeter was not at their base, for instance because they contain projecting parts.

The invention claimed is:

1. Self-propelled machine for wrapping stacked loads with a protective film which unwinds from a reel, comprising an elevator system (2) for vertical movement of reel (11), and a mobile supporting carriage (4) characterized in that it comprises: two driving wheels (40, 41) arranged on the same axis, each driven by its own independent motor (42, 43); and an automatic guidance system (5) with a contact device (50) adapted to follow a contact surface (32) of the stacked load (31) and to detect its distance from the machine, and a servocontrol (51) which is responsive to the distance detected by said contact device (50), adapted to control said driving motors of the machine in such a way that the machine follows the shape of the contact surface (32), wherein said two driving wheels (40, 41) are located in the front pad of the mobile supporting carriage (4), ahead of a swiveling wheel (44), said swiveling wheel (44) being adapted to support the machine and to stabilize its motion.

2. Self-propelled wrapping machine according to claim 1, characterised in that said contact device (50) is adapted to change its position with respect to the machine according to the profile of said contact surface (32).

3. Self-propelled wrapping machine according to claim 2, characterised in that said servocontrol (51) comprises a potentiometer (52) adapted to produce an electrical signal adjusted by the relative position of an adjusting device, determined by the relative position of the contact device (50); said electrical signal controlling the speed of the wheels (40, 41) via driving motors (42, 43).

4. Self-propelled wrapping machine according to claim 3, characterised in that said contact device (50) is adapted to swing in a horizontal plane until it comes into contact with said contact surface (32), said swinging producing a corresponding rotation of the adjusting device of the potentiometer (52) in such a way as to adjust the signal produced by the potentiometer (52).

5. Self-propelled wrapping machine according to claim 4, characterised in that said contact device (50) comprises: a contact roller (54), adapted to roll along said contact surface (32) following its profile; a supporting arm (55) of roller (54), hinged onto the machine by a hinge (57) and free to rotate around said hinge (57) following the movements of said contact roller (54) relative to the machine; a gearwheel sector (56) attached to said arm (55) and coaxial with hinge (57), adapted to mesh with said adjusting means of the potentiometer, which takes the form of a pinion (53), thus making it rotate following the rotation of said arm, (55); and a spring (59) attached to said gearwheel sector (56) that presses the contact roller (54) against the contact surface (32), ensuring that it follows its profile at all times.

6. Self-propelled wrapping machine according to claim 1, characterised in that said driving wheels (40, 41) are located behind said reel (11).

* * * * *